US008840203B2

(12) United States Patent
Bohle

(10) Patent No.: US 8,840,203 B2
(45) Date of Patent: Sep. 23, 2014

(54) EJECTING DEVICE FOR A MOVABLE FURNITURE PART

(71) Applicant: Julius Blum GmbH, Hochst (AT)

(72) Inventor: Wolfgang Bohle, Gotzis (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 13/767,099

(22) Filed: Feb. 14, 2013

(65) Prior Publication Data

US 2013/0154461 A1 Jun. 20, 2013

Related U.S. Application Data

(63) Continuation of application No. PCT/AT2011/000263, filed on Jun. 15, 2011.

(30) Foreign Application Priority Data

Aug. 26, 2010 (AT) ..... A 1424/2010

(51) Int. Cl.
*A47B 95/02* (2006.01)
*A47B 88/04* (2006.01)
*E05F 15/12* (2006.01)

(52) U.S. Cl.
CPC ..... *E05F 15/121* (2013.01); *A47B 88/0414* (2013.01); *E05Y 2900/20* (2013.01)
USPC ..... 312/319.8

(58) Field of Classification Search
CPC ..... A47B 88/0014; A47B 88/047; A47B 88/0477; A47B 88/0414
USPC ..... 312/330.1, 319.1, 319.5–319.8; 49/276–278, 356
See application file for complete search history.

(56) References Cited

U.S. PATENT DOCUMENTS 8,029,078 B2 10/2011 Gasser
2007/0180654 A1 8/2007 Gasser
(Continued)

FOREIGN PATENT DOCUMENTS

AT 007 158 11/2004
AT 009 928 6/2008
(Continued)

OTHER PUBLICATIONS

International Search Report issued Oct. 18, 2011 in International (PCT) Application No. PCT/AT2011/000263.

(Continued)

*Primary Examiner* — Matthew Ing
(74) *Attorney, Agent, or Firm* — Wenderoth, Lind & Ponack, L.L.P.

(57) ABSTRACT

An ejecting device for a movable furniture part includes an ejector, which can be moved between a first and a second position, for ejecting the movable furniture part, a drive train having an electrical drive unit that drives the ejector and a gear mechanism arranged between the drive unit and the ejector and which has an output that acts on the ejector, and an open-loop or closed-loop control device for controlling the drive unit in an open-loop or closed-loop manner. A force accumulator is integrated in the gear mechanism between the drive unit and the output, and a monitoring device connected to the drive train can detect an unloading of the force accumulator and report the unloading to the open-loop or closed-loop control device. The open-loop or closed-loop control device activates the electrical drive unit to move the ejector back to the first position after detection of the unloading.

19 Claims, 11 Drawing Sheets

(56) References Cited

U.S. PATENT DOCUMENTS

| | | | |
|---|---|---|---|
| 2008/0111455 | A1 | 5/2008 | Fitz |
| 2010/0037715 | A1 | 2/2010 | Gasser |
| 2011/0309729 | A1 | 12/2011 | Gasser |

FOREIGN PATENT DOCUMENTS

| | | |
|---|---|---|
| CN | 101208027 | 6/2008 |
| CN | 101240970 | 8/2008 |
| CN | 101563004 | 10/2009 |
| WO | 2006/017864 | 2/2006 |
| WO | 2007/092969 | 8/2007 |
| WO | 2008/092495 | 8/2008 |
| WO | 2008/128256 | 10/2008 |
| WO | 2009/152537 | 12/2009 |

OTHER PUBLICATIONS

Austrian Patent Office Search Report completed Apr. 28, 2011 in Austrian Patent Application No. A 1424/2010.

EJECTING DEVICE FOR A MOVABLE FURNITURE PART

BACKGROUND OF THE INVENTION

The invention concerns an ejection device for a movable furniture part, in particular a door or drawer, comprising an ejector movable between a first position and a second position for ejecting the movable furniture part, a drive train having an electric drive unit for driving the ejector and a transmission arranged between the drive unit and the ejector and having a drive output acting on the ejector, and a control or regulating device for controlling or regulating the drive unit.

Electrically driven ejection devices are already known. For example, AT 007 158 U1 describes an ejector for a movable furniture part, wherein the drive unit can be triggered by applying a pulling force and/or a pushing force to the ejection device. In a specific embodiment in which the ejector includes two parts which are arranged telescopically one within the other, the movement of the movable furniture part away from the ejector can be detected after the termination of the ejection operation and the retraction process of the ejector can be triggered as a reaction thereto. A disadvantage in that respect is that the force storage means required for that detection is disposed in the ejection push rod itself, whereby detectability is dependent on the form of the ejection push rod.

WO 2006/017864 A1 concerns an ejection device for a movable furniture part, wherein a first roller is arranged at the free lever end and a second roller is arranged at a spacing from the free lever end. In an embodiment described therein, the pivotably mounted lever comprises two lever parts which can be prestressed relative to each other by a spring, and the position of one of those lever parts can be detected. In this case, that spring is provided after the drive output of the transmission and is thus a component of the actual ejector whereby in this case also detectability of unloading of the force storage means presupposes a given form for the ejector.

SUMMARY OF THE INVENTION

Therefore the object of the invention is to provide an ejection device which is improved over the state of the art. In particular, the invention seeks to provide that detection of unloading of the force storage means is effected independently of the form of the ejector. In other words, the invention seeks to provide an ejection device in which the ejector can in itself be of any desired configuration and nonetheless it is possible to draw a conclusion about the position of the ejector, from the transmission.

In the ejection device according to the invention, that object is achieved in that a force storage means is integrated in the transmission between the drive unit and the drive output. Unloading of the force storage means can be detected by a monitoring device connected to the drive train and can be signaled to the control or regulating device. After detection of the unloading of the force storage means, the control or regulating device activates the electric drive unit for moving the ejector back into the first position.

In an ejection device according to the invention a force storage means whose unloading can be detected and can be used as a trigger for retraction movement of the ejector is disposed between the drive unit and the drive output, that is to say it is therefore within the transmission of the drive train. As the drive output of the transmission acts on the ejector, the form of the ejector is independent of possible detectability of unloading of the force storage means. Accordingly, the transmission can be produced in the form of a structural unit and the ejection device can then be retro-fitted with ejectors of any desired shape or configuration.

In a preferred embodiment, the ejector is movable with a translatory movement. That represents a particularly simple form of force actuation on the movable furniture part by the ejector. In principle, however, the ejector could also be pivotable or movable in another form.

Preferably, the ejector can be in one piece with the drive output of the transmission. That reduces the complexity of the ejector and permits particularly simple production thereof. It will be appreciated that it is, however, also possible for the ejector and the drive output to be in the form of separate parts in order thereby to make the ejector independent of a transmission member.

The electric drive unit can include an electric motor. That can permit driven automatic movement of the ejector in the extension and retraction directions.

In a particularly preferred embodiment of the invention, the drive train is of such a design that the transmission has two gears which are movable limitedly relative to each other. That limited relative mobility permits the interposition of a force storage means therebetween, whose unloading can be detected as a further consequence.

If the two gears are arranged in mutually coaxial relationship, that can permit a particularly compact structure.

In a further embodiment, the first gear is connected to the drive unit by a worm and the second gear is connected to the ejector. That embodiment permits a compact structure for the drive train with at the same time a minimum number of transmission components. In principle, however, the gears can be connected to any number of transmission components.

It has proven to be particularly advantageous if the force storage means is between the two gears. The force storage means can also be loaded and unloaded only in a limited operating range, due to the limited relative mobility of the two gears. That prevents excessive stressing of the force storage means, in particular beyond the limits of the intended operating range.

A particularly advantageous embodiment of the invention is one in which the gears can be prestressed relative to each other by the force storage means. That permits particularly easy detection of unloading of the force storage means insofar as the monitoring device is connected to that gear which is moved upon unloading of the force storage means.

A further advantageous embodiment of the invention is of such a design that the monitoring device has a measuring potentiometer. In principle, the monitoring device may also include other movement detectors or other sensors by which unloading of the force storage means can be detected.

Further, the monitoring device can be connected to the drive train by means of at least one monitoring gear. As a result, the monitoring device can be connected directly to the transmission of the drive train and thus register movements within the transmission.

It has proven to be particularly advantageous in that respect if the monitoring gear engages that gear which is connected to the ejector. In that case, the movement of the ejector is detected directly, in particular that movement after removal of the movable furniture part in the extended second position of the ejector. It is however also possible for the monitoring gear to be coupled to the transmission at another location.

In a further preferred embodiment of the ejection device, the force storage means includes at least one spring which is preferably a coil spring. That kind of force storage means is particularly simple and inexpensive. Equally however the force storage means can include a fluid pressure storage means or a magnet.

In a preferred embodiment of the invention, unloading of the force storage means is effected after attainment of the second position (FIG. 5) of the ejector by removal of the force actuation acting against the loaded force storage means. If removal of the force actuation is effected by moving the movable furniture part away from the ejector, whereby the force storage means moves the ejector into the third position (FIG. 6), opening of the movable furniture part for example can be detected after ejection and the drive unit can be caused by way of the control or regulating device to move the ejector back into the first position (FIG. 7). It is possible in that way, for example, to prevent anyone from injuring themselves when the article of furniture is opened, on the extended ejector.

BRIEF DESCRIPTION OF THE DRAWINGS

Further details and advantages of the invention will be described more fully hereinafter by means of the specific description with reference to the embodiments illustrated by way of example in the drawings, in which.

DETAILED DESCRIPTION OF THE INVENTION

Figure 1:
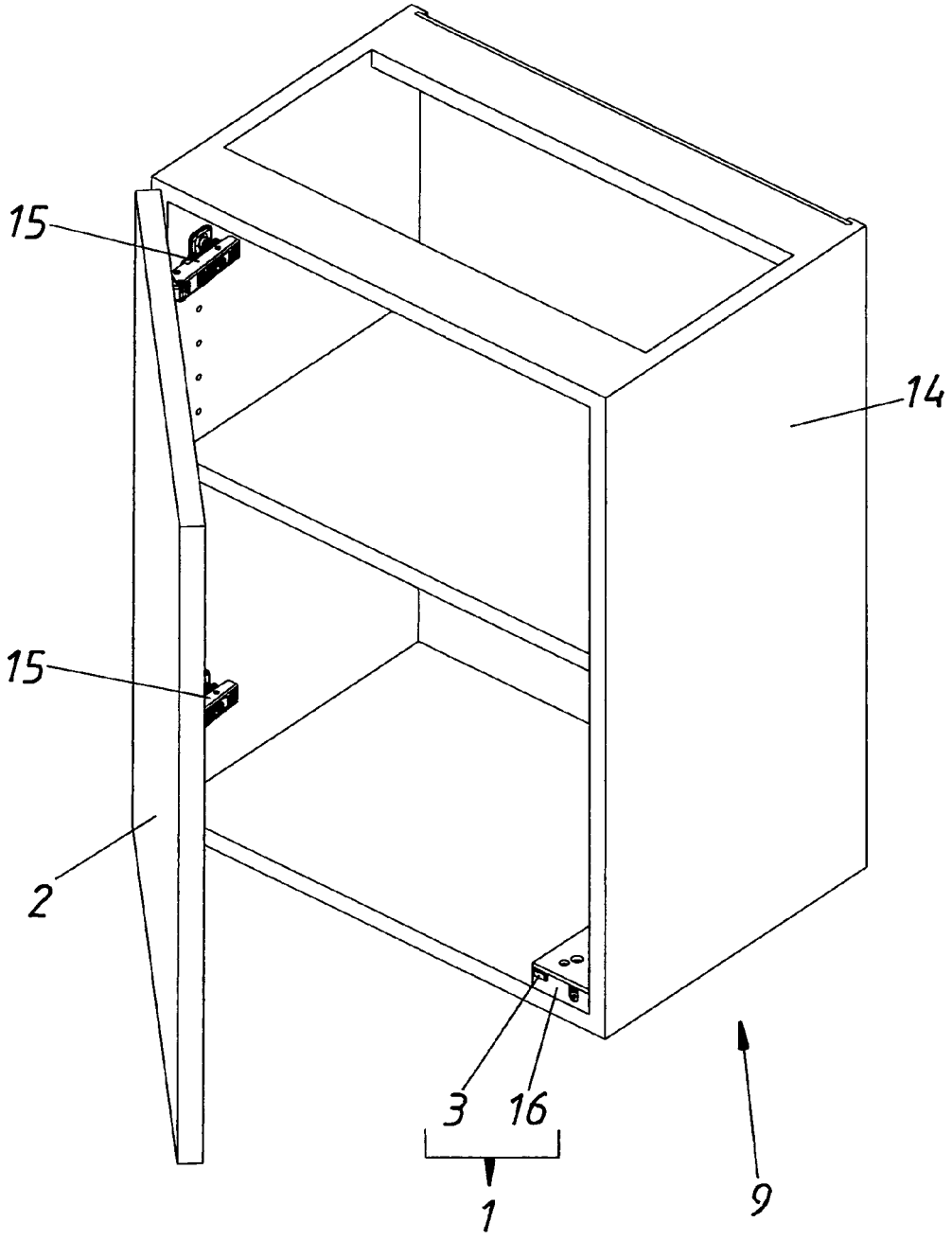
FIG. 1 shows a perspective view of an article of furniture with an incorporated ejection device.

FIG. 1 shows an article of furniture 9 including a furniture carcass 14 and a movable furniture part 2 fixed movably to the furniture carcass 14 by means of two hinges 15. An ejection device 1 is mounted at the bottom right corner of the furniture carcass 14. In particular, the housing 16 and the ejector 3 can be seen in this view in the retracted first position of the ejection device.

Figure 2:
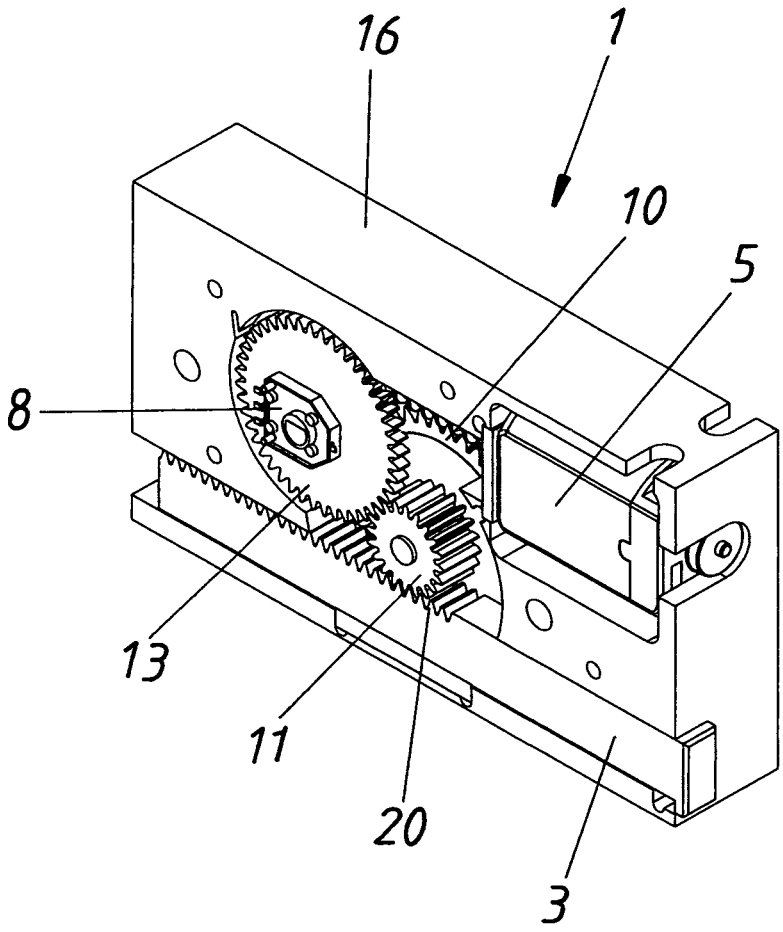
FIG. 2 shows a perspective view of the ejection device.

FIG. 2 shows the ejection device 1 in the retracted first position of the ejector 3. In this embodiment of the invention, the ejector 3 is in one piece with the drive output 20 of the transmission 19. The monitoring device 8 is formed here by a measuring potentiometer coupled to the transmission member 11 by a monitoring gear 13.

Figure 3:
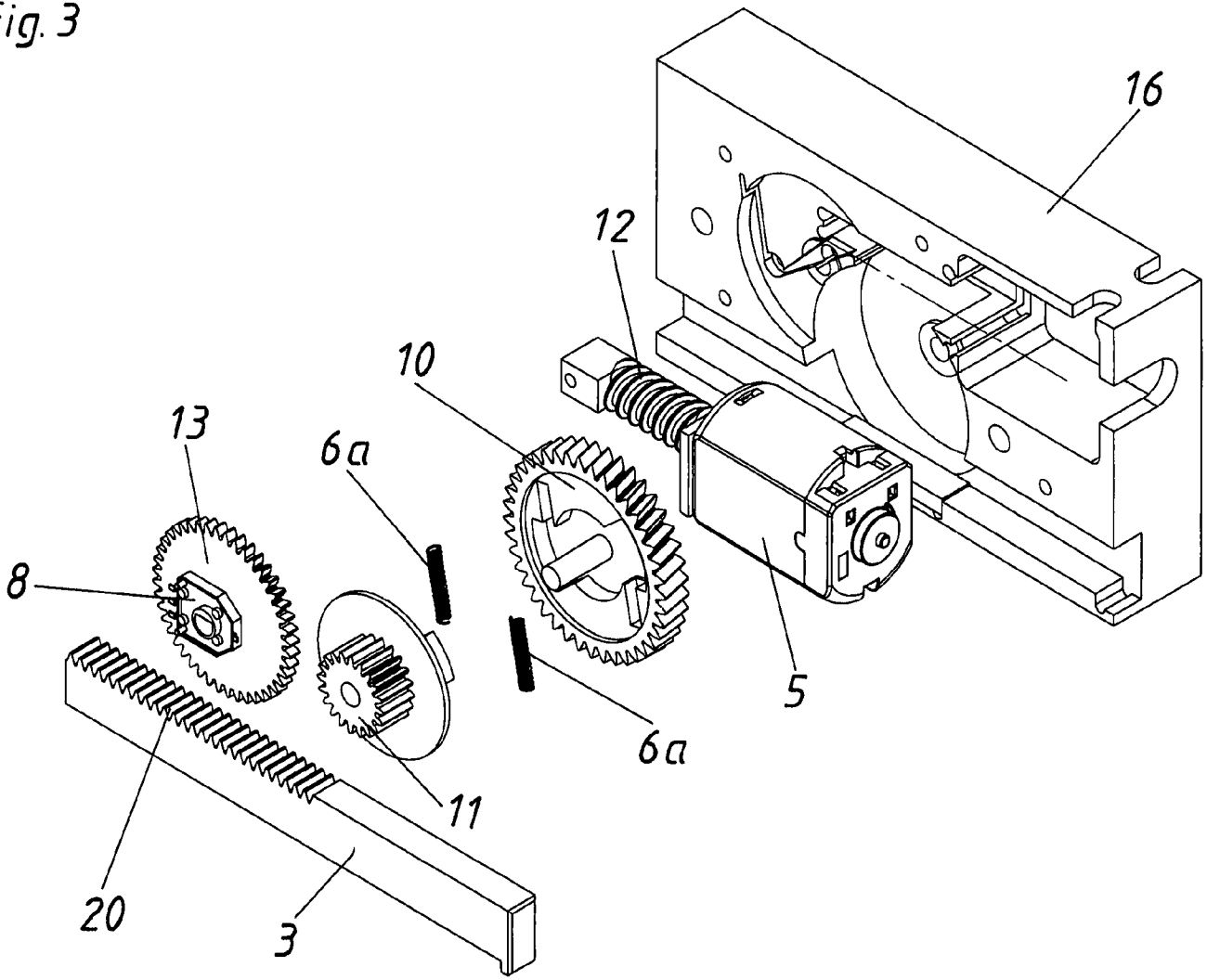
FIG. 3 shows an exploded view of the ejection device.

FIG. 3 shows an exploded view of the ejection device 1 comprising housing 16, electric drive unit 5, worm 12 connected to a drive shaft of the drive unit 5, first gear 10, second gear 11, force storage means 6 arranged between first and second gears 10 and 11 and in the form of two coil springs 6*a*, a monitoring gear 13 and a monitoring device 8 connected thereto as well as the drive output 20 of the transmission 19 and the ejector 3.

Figure 4:
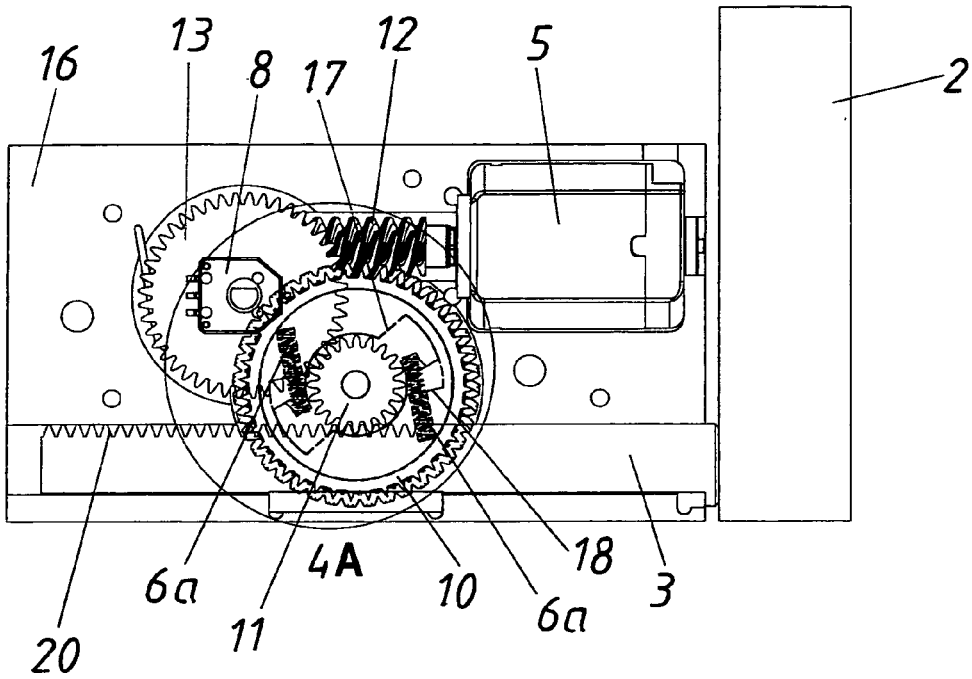
FIGS. 4 and 4A show a side view of the ejection device in the first retracted position with the furniture part closed and an enlarged detail view.
Figure 4A:
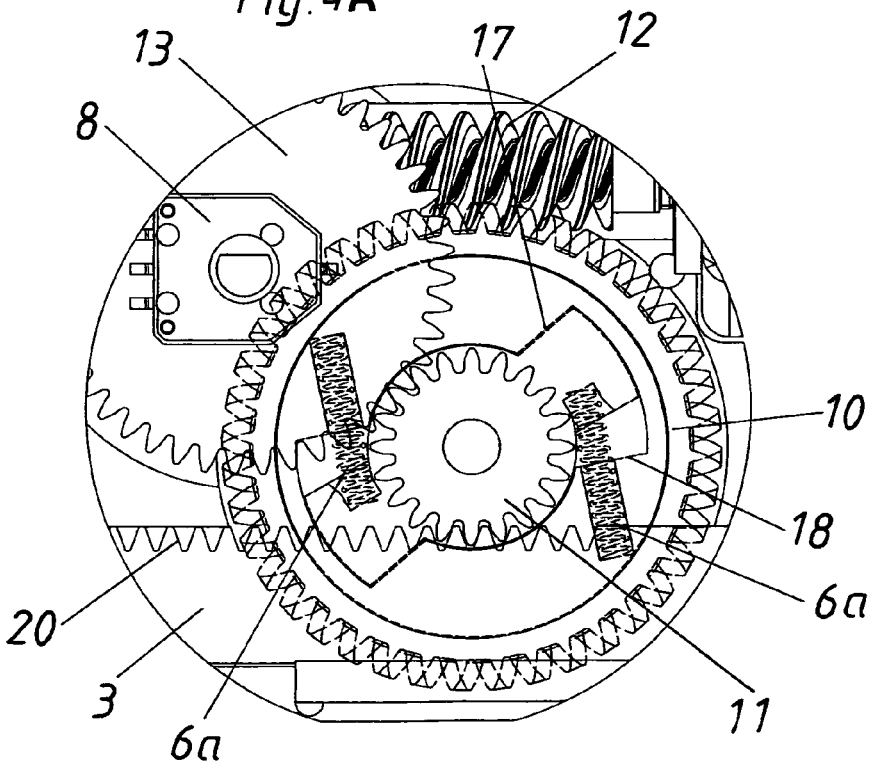

FIGS. 4 and 4A show a side view of the ejection device 1 when the movable furniture part 2 is in the closed position and thus the ejector 3 is in its first retracted position. In that case, FIG. 4A shows a view of a portion on an enlarged scale in particular of the two gears 10 and 11 and the force storage means 6 which in this case is in the form of two coil springs 6*a*. The electric drive unit 5 is connected to the first member of the transmission 19, here in the form of the worm 12. During the ejection process that worm 12 moves the first gear 10 in the counter-clockwise direction whereby the force storage means 6*a* can be loaded to that point at which the second abutment 18 of the first gear 10 contacts the hook-shaped part of the second gear 11 and thus that second gear 11 is also moved in the counter-clockwise direction. The second gear 11 is connected to the drive output 20 of the transmission 19 whereby the ejector 3 is extended from the housing 16 with a translatory movement (towards the right) and thus moves the movable furniture part 2 in the opening direction. The monitoring device 8 connected to the monitoring gear 13 is also visible here. That monitoring gear 13 is coupled to the second gear 11 whereby the rotary movement thereof can be monitored. In particular, unloading of the force storage means 6*a*, which is only limitedly made possible by the abutments 17 and 18, can thereby also be detected.

Figure 5:
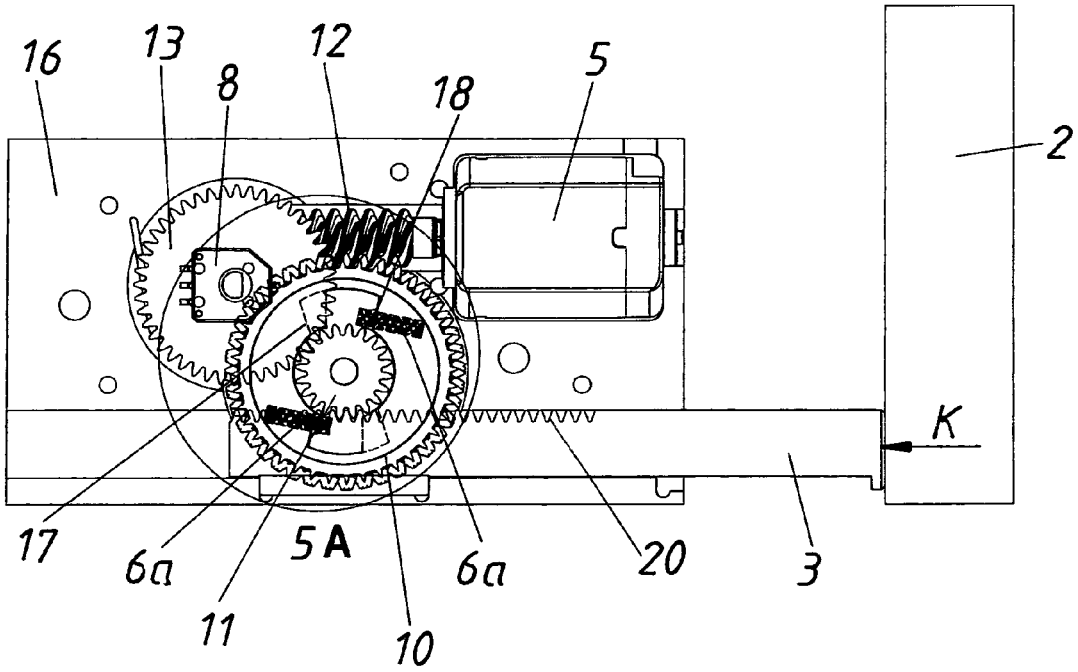
FIGS. 5 and 5A show a side view of the ejection device in the second extended position with the furniture part in contact and an enlarged detail view.
Figure 5A:
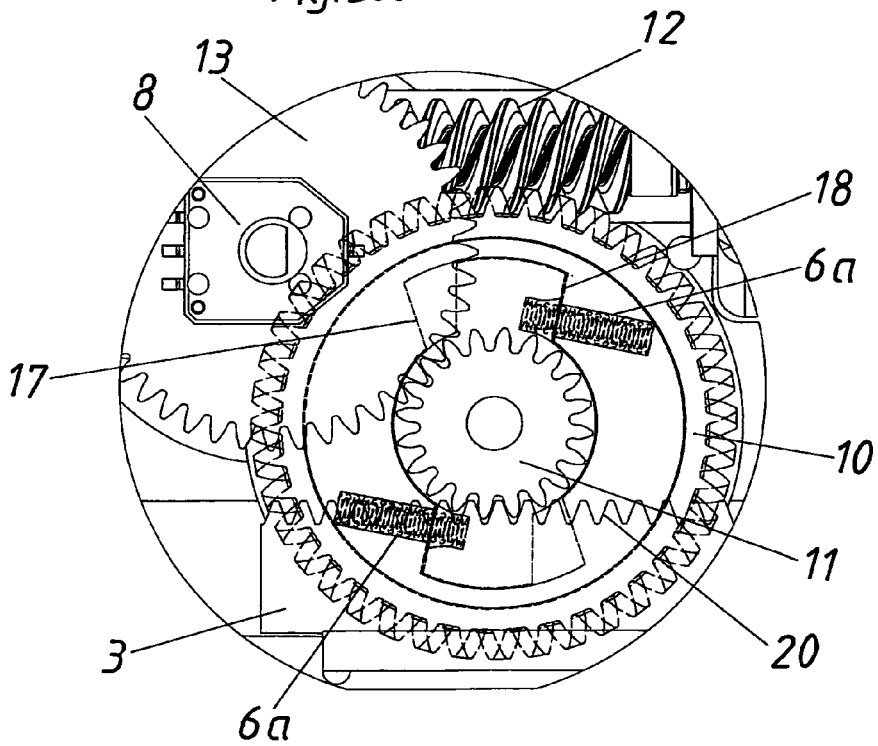

FIGS. 5 and 5A show a side view of the ejection device 1 in the extended second position of the ejector 3 which has thus correspondingly moved the movable furniture part 2 in the opening direction. In that case, FIG. 5A shows a view on an enlarged scale of a portion of the detail 5A. In that view, the movable furniture part 2 has been ejected in the opening direction by the ejector 3 but still remains thereat whereby a force actuation K corresponding to the illustrated arrow acts against the ejector 3. Because of that force actuation K, it is not possible for the loaded force storage means 6*a* to unload. The force actuation K acts in a translatory movement towards the left on the drive output 20 by means of the ejector 3 whereby a force in opposition to unloading of the force storage means 6*a* acts on the latter in the second gear 11.

Figure 6:
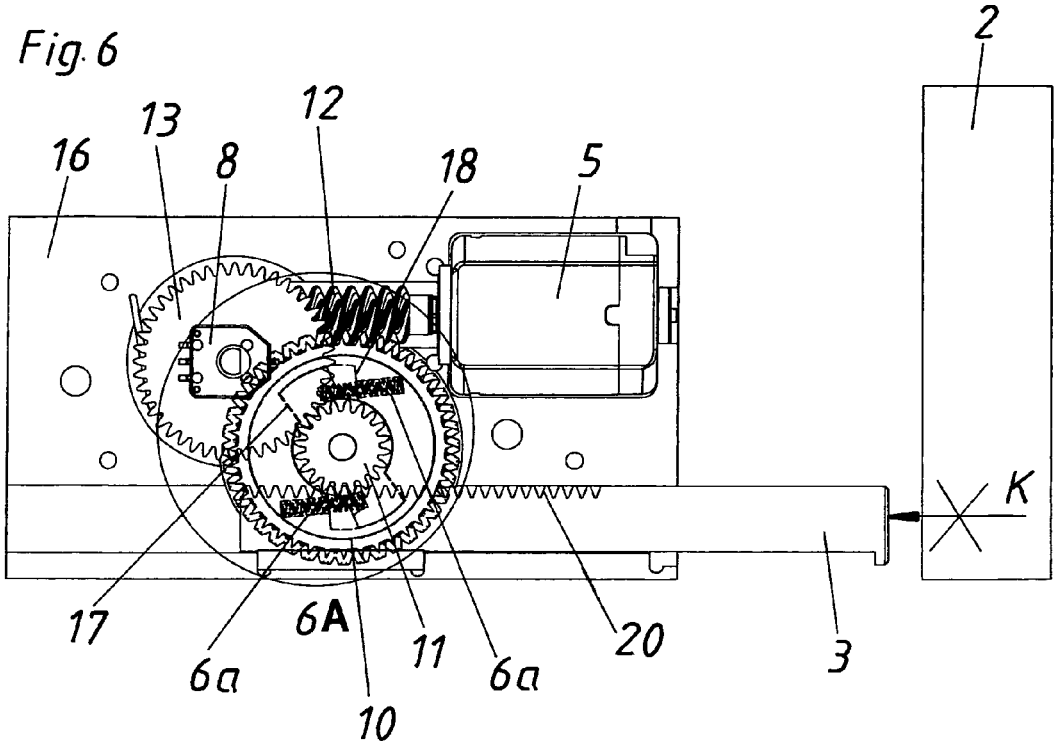
FIGS. 6 and 6A show a side view of the ejection device with the furniture part removed (third position) and an enlarged detail view.
Figure 6A:
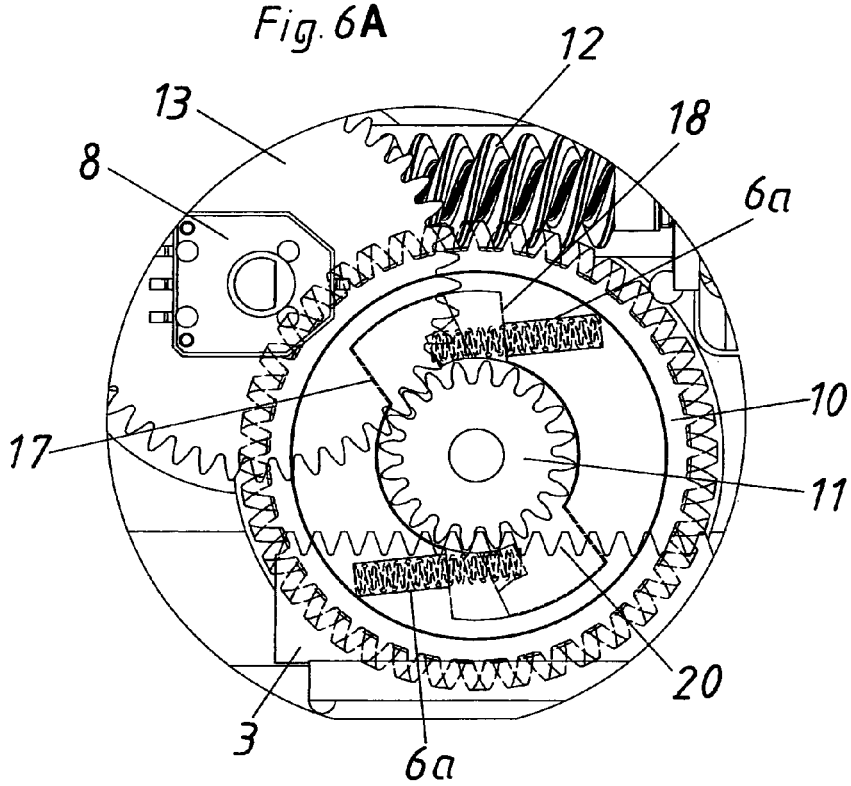

FIGS. 6 and 6A show a side view of the ejection device 1, wherein the movable furniture part 2 has been moved still further away in the opening direction, after ejection has been effected by the ejector 3. Removal of the movable furniture part 2 from the ejector 3 which is in its second extended position means that the force actuation K acting against the ejector 3 is also removed (illustrated by crossed out arrow). Because of the force action which also disappears therewith against the loaded force storage means 6*a* due to the second gear 11 by means of the drive output 20, it is now possible for the loaded force storage means 6*a* to be able to unload. That unloading has the result that the second gear 11 moves to a limited extent in the counter-clockwise direction, more specifically until the hook-shaped part of the second gear 11 which prior to unloading of the force storage means 6*a* bears against the second abutment 18 is moved by unloading of the loaded force storage means 6*a* in the counter-clockwise direction until the rear part of the hook-shaped part of the second gear 11 bears against the first abutment 17. By means of the transmission action, that limited rotational movement in the counter-clockwise direction of the second gear 11, by way of the drive output 20, is converted into a translatory movement towards the right of the ejector 3 which can now be extended correspondingly further into its third position. By virtue of coupling of the monitoring gear 13 to the second gear 11, that unloading of the force storage means 6*a* by means of transmission action can be registered as a rotary movement in the clockwise direction of the monitoring gear 13 by the monitoring device 8 which is connected to the monitoring gear 13, whereupon, according to the invention, the electric drive unit 5 is actuated or activated by the control or regulating device 7 (not shown here) to move the ejector 3 back into the first retracted position.

Figure 7:
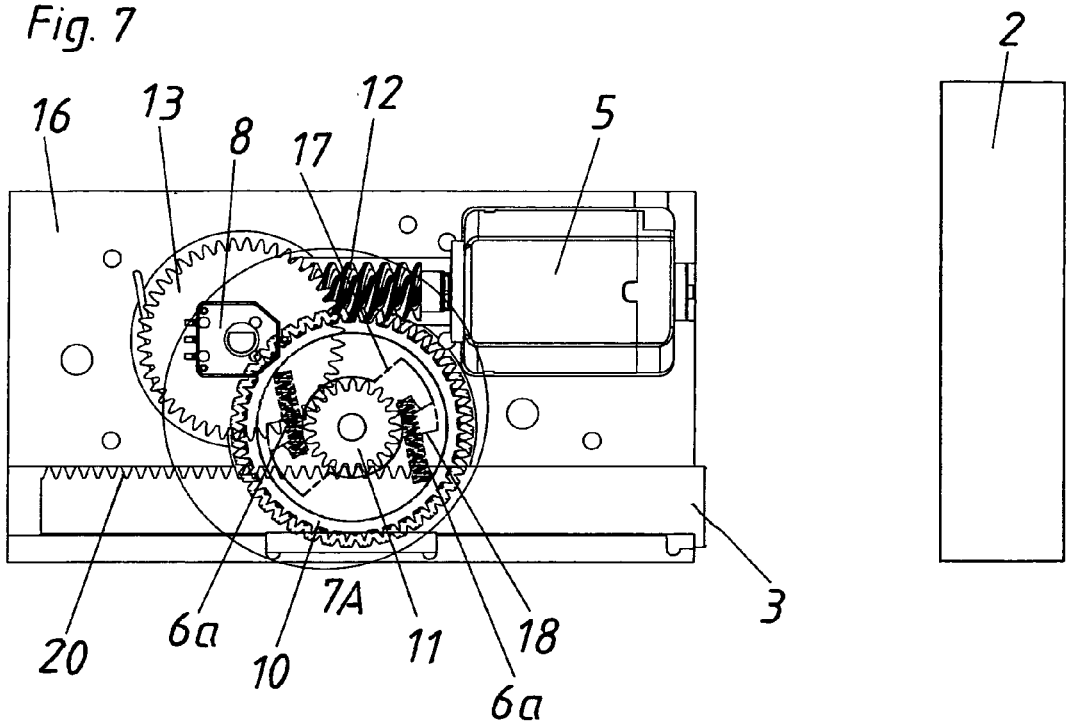
FIGS. 7 and 7A show a side view of the ejection device with the ejector retracted again in the first position and an enlarged detail view.
Figure 7A:
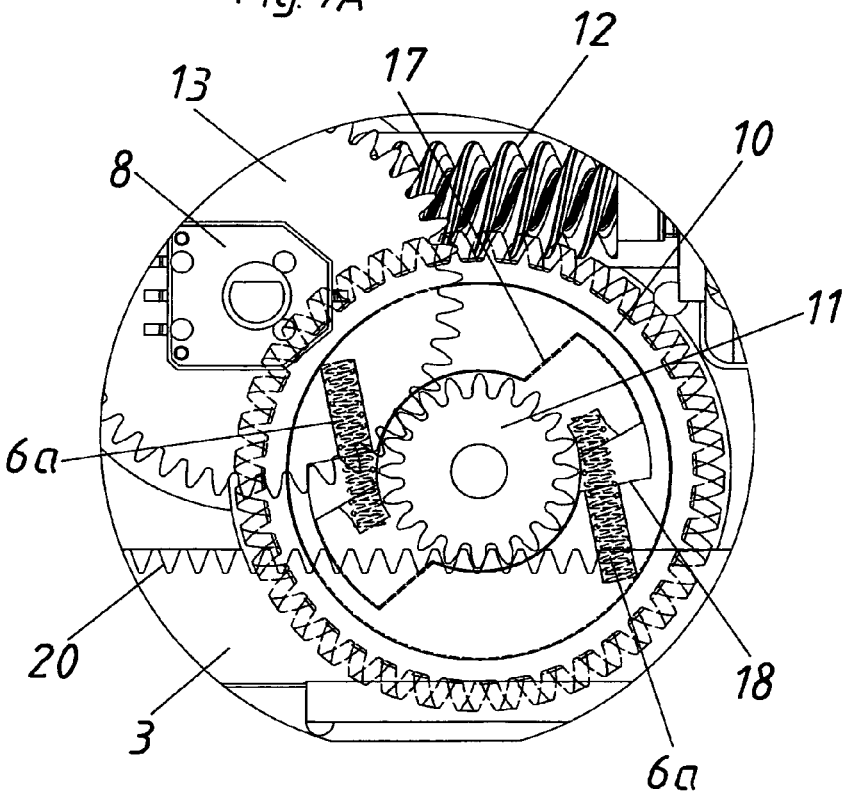

FIGS. 7 and 7A show a side view of the ejection device 1 after the ejector 3 was moved back again into its first retracted position after detection of unloading of the force storage means 6*a*, by the drive unit 5. Retraction of the ejector 3 into its first position is achieved by the electric drive unit 5 rotationally moving the first gear 10 in the clockwise direction by means of a transmission action. As after unloading of the force storage means 6*a* has occurred the hook-shaped part of the second gear 11 bears against the first abutment 17, that second gear 11 is also rotationally moved in the clockwise direction. That second gear 11 acts on the drive output 20 of the transmission 19 and thus leads to a translatory movement towards the left of the ejector 3 to its first retracted position.

Figure 8:
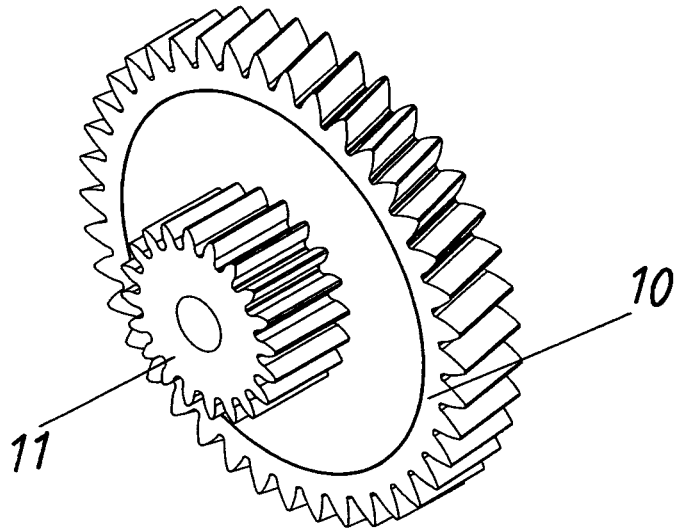
FIG. 8 shows a perspective view of the two assembled gears of the transmission, which are limitedly movable relative to each other.

FIG. 8 shows a perspective view of the two assembled gears 10 and 11 which are movable limitedly relative to each other by a hollow space (not visible here) in the first gear 10 and a hook-shaped part (also not visible here) provided on the second gear 11.

Figure 9:
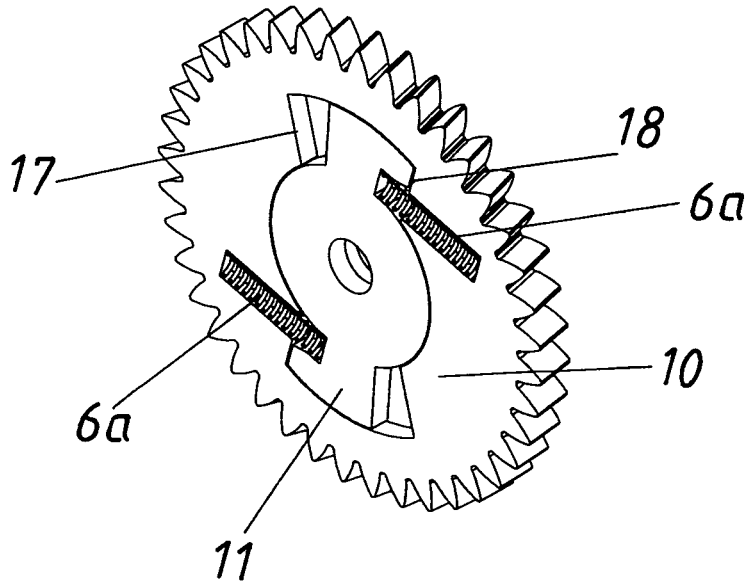
FIG. 9 shows a perspective view of the loaded force storage means in the form of a coil spring.

FIG. 9 shows the relative position of the two gears 10 and 11 with respect to each other when the force storage means 6*a* are loaded. In this case, the hook-shaped part of the second gear 11 bears against the second abutment 18 of the first gear 10.

Figure 10:
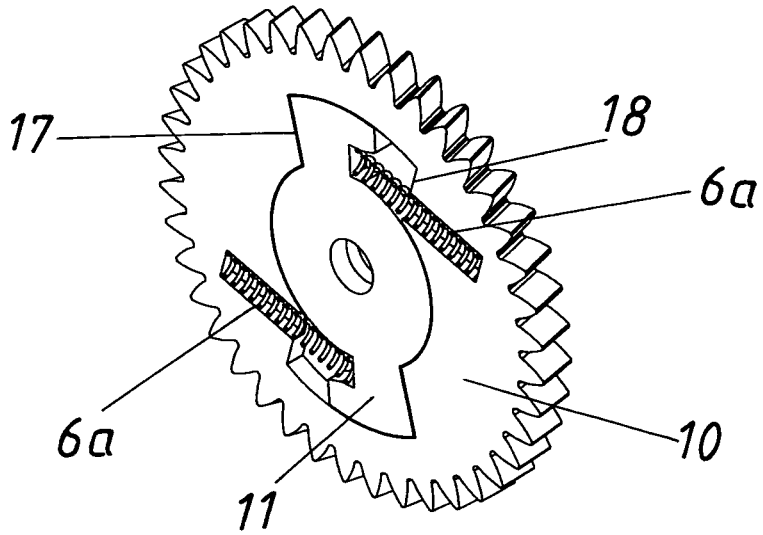
FIG. 10 shows a perspective view of the unloaded force storage means in the form of a coil spring.

FIG. 10 shows the relative position of the two gears 10 and 11 with respect to each other when the force storage means 6*a* are unloaded. In this case, the rear part of the hook-shaped part of the second gear 11 bears against the first abutment 17 of the first gear 10.

Figure 11:
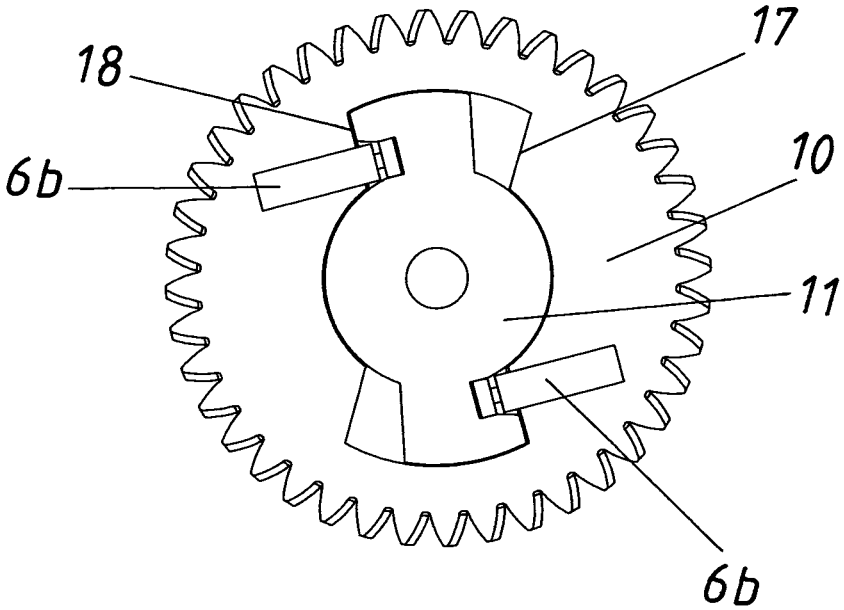
FIG. 11 shows a side view of the loaded force storage means in the form of a fluid pressure storage means.

FIG. 11 shows alternative force storage means 6, here in the form of fluid pressure storage means 6*b*. The force storage means 6*b* are loaded in the illustrated relative position of the two gears 10 and 11 with respect to each other.

Figure 12:
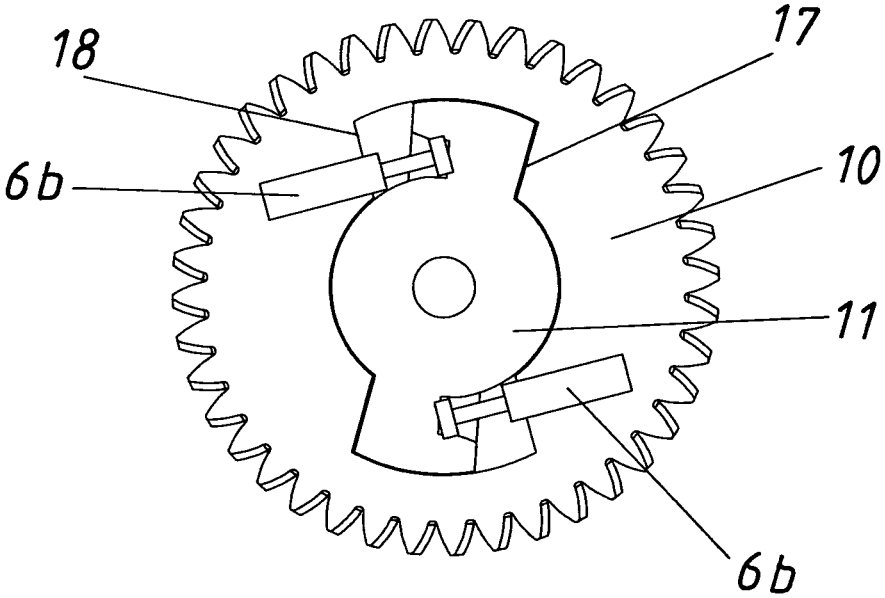
FIG. 12 shows a side view of the unloaded force storage means in the form of a fluid pressure storage means.

FIG. 12 shows the relative position of the two gears 10 and 11 with respect to each other when the two force storage means 6 which here are in the form of fluid pressure storage means 6*b* are unloaded.

Figure 13:
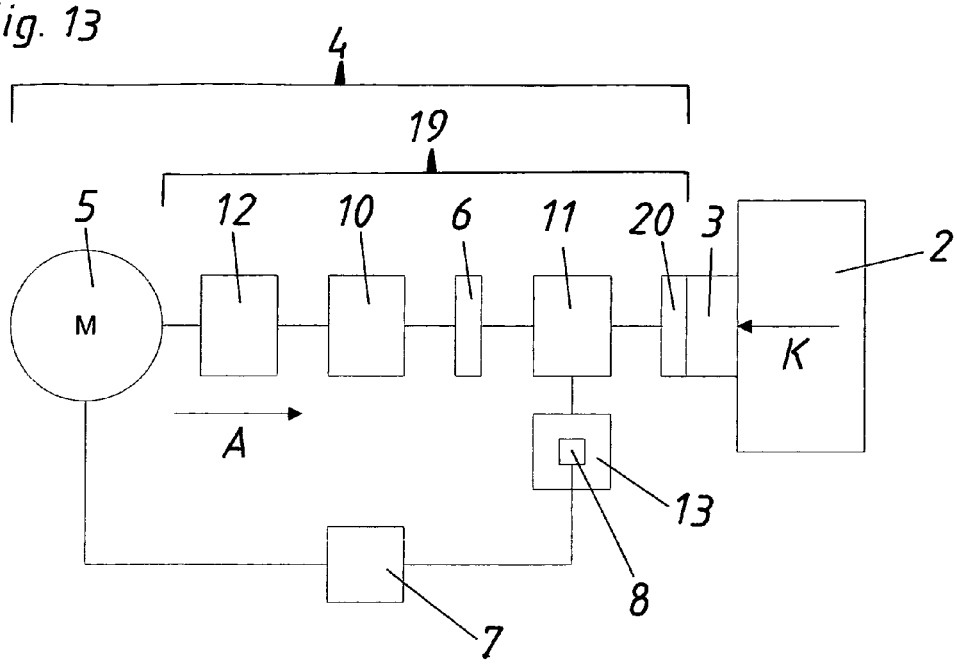
FIG. 13 shows a schematic block circuit diagram of the essential components of the ejection device with the force storage means loaded.

FIG. 13 diagrammatically shows the most important components of the ejection device 1, comprising electric drive unit 5, the drive member of the transmission 19 in the form of a worm 12, first gear 10, force storage means 6, second gear 11, drive output 20 of the transmission 19 and ejector 3, as well as the monitoring gear 13 coupled to the second gear 11, the monitoring device 8 connected thereto, and the control or regulating device 7. In this view, the ejector 3 is in its second extended position, wherein the movable furniture part 2 still bears against the ejector 3 and thus a force actuation K acts in opposite relationship to the extension direction of the ejector 3. The force action A in the drive train 4 diagrammatically shows that in principle the force actuation K acts in opposite relationship to the force action A in the drive train 4. The ejector 3 is in its second extended position and the force storage means 6 is loaded.

Figure 14:
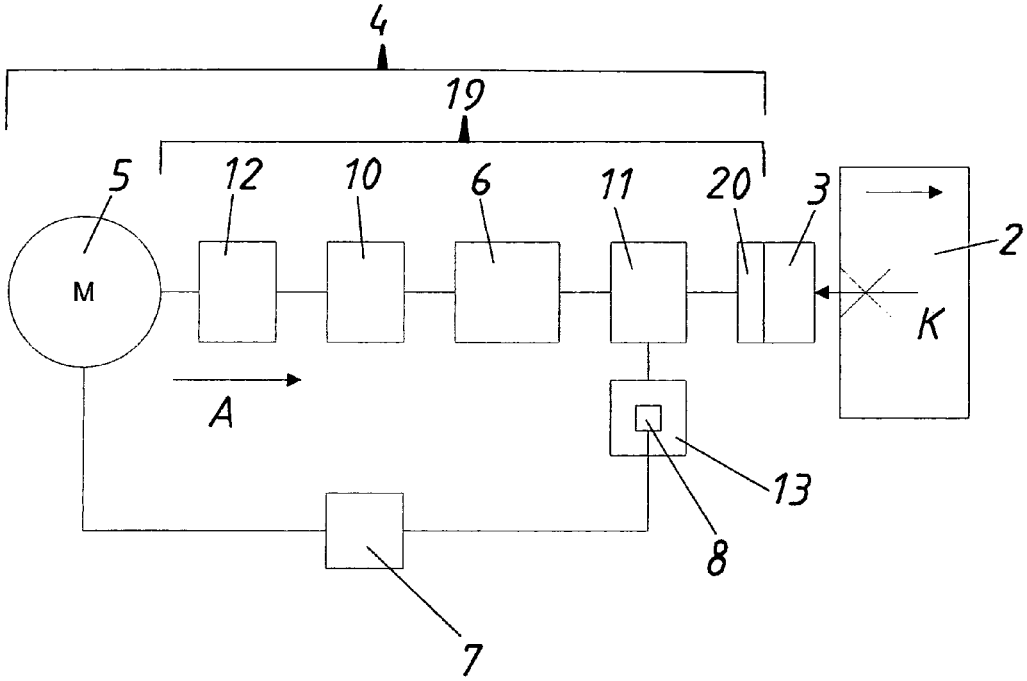
FIG. 14 shows a schematic block circuit diagram of the essential components of the ejection device with the force storage means unloaded.

FIG. 14 shows the most important components of the ejection device 1 after extension of the ejector 3 into its second position and after removal of the movable furniture part 2 from the ejector 3 in the opening direction. Due to the removal of the movable furniture part 2, the force actuation K acting by the ejector 3 and the transmission members 20 and 11 against the loaded force storage means 6 disappears and the force storage means 6 can be unloaded. As a result, the ejector 3 is moved further in the extension direction into its third position by transmission members 11 and 20, and that movement within the transmission 19 is detected by the monitoring device 8 by the monitoring gear 13. That detection causes the control or regulating device 7 to activate the electric drive unit 5 to move the ejector 3 back into its first retracted position again by the transmission 19.

The invention claimed is:

1. An ejection device for a movable furniture part, said ejection device comprising:

an ejector movable between a first position and a second position for ejecting the movable furniture part;

a drive train having an electric drive unit for driving said ejector, and a transmission arranged between said electric drive unit and said ejector and having a drive output acting on said ejector;

a control or regulating device for controlling or regulating said electric drive unit;

a force storage means integrated in said transmission between said electric drive unit and said drive output; and a monitoring device for detecting unloading of said force storage means, said monitoring device being connected to said drive train to signal detection of the unloading of said force storage means to said control or regulating device, and wherein said control or regulating device is configured to activate said electric drive unit to move said ejector back into the first position after the detection of the unloading of the force storage means.

2. The ejection device as set forth in claim 1, wherein said ejector is movable with a translatory movement.

3. The ejection device as set forth in claim 1, wherein said ejector has a one piece construction with said drive output of said transmission.

4. The ejection device as set forth in claim 1, wherein said electric drive unit includes an electric motor.

5. The ejection device as set forth in claim 1, wherein said transmission has two gears limitedly movable relative to each other.

6. The ejection device as set forth in claim 5, wherein said two gears are coaxial.

7. The ejection device as set forth in claim 5, wherein said two gears comprise a first gear connected to said drive unit by a worm and a second gear connected to said ejector.

8. The ejection device as set forth in claim 5, wherein said force storage means is located between said two gears.

9. The ejection device as set forth in claim 8, wherein said two gears are configured to be prestressed relative to each other by said force storage means.

10. The ejection device as set forth in claim 1, wherein said monitoring device has a measuring potentiometer.

11. The ejection device as set forth in claim 1, wherein said monitoring device is connected to said drive train by at least one monitoring gear.

12. The ejection device as set forth in claim 11, wherein said at least one monitoring gear engages a second gear connected to said ejector.

13. The ejection device as set forth in claim 1, wherein said force storage means includes at least one spring.

14. The ejection device as set forth in claim 13, wherein said at least one spring is a coil spring.

15. The ejection device as set forth in claim 1, wherein said force storage means includes a fluid pressure storage means or a magnet.

16. The ejection device as set forth in claim 1, wherein said force storage means is configured to allow unloading thereof after attainment of the second position of said ejector by removal of an actuation force acting against said force storage means.

17. The ejection device as set forth in claim 16, wherein removal of the actuation force is effected by moving the movable furniture part away from said ejector whereby said force storage means moves said ejector into the third position.

18. An article of furniture comprising:

a movable furniture part; and said ejection device as set forth in claim 1 configured to eject said movable furniture part.

19. The article of furniture as set forth in claim 18, wherein said movable furniture part is a door or a drawer.

* * * * *